United States Patent [19]

Reinhall

[11] Patent Number: 5,067,660

[45] Date of Patent: Nov. 26, 1991

[54] STRESS REGULATOR FOR PULP GRINDING APPARATUS AND METHOD

[75] Inventor: Rolf B. Reinhall, Bellevue, Wash.

[73] Assignee: Sunds Defibrator AB, Sundsvall, Sweden

[21] Appl. No.: 598,796

[22] Filed: Oct. 15, 1990

Related U.S. Application Data

[63] Continuation of Ser. No. 425,347, Sep. 27, 1989, abandoned, which is a continuation of Ser. No. 228,526, Aug. 4, 1988, abandoned.

[51] Int. Cl.[5] ..... B02C 7/14

[52] U.S. Cl. ..... 241/37; 241/259.2

[58] Field of Search ..... 241/37, 259.1, 259.2, 241/259.3

[56] References Cited

U.S. PATENT DOCUMENTS

| | | | |
|---|---|---|---|
| 2,971,704 | 2/1961 | Johansson | 241/37 |
| 3,032,282 | 5/1962 | Asplund | 241/259.1 X |
| 3,212,721 | 10/1965 | Asplund et al. | 241/37 |
| 4,002,299 | 1/1977 | Skalka | 241/37 |
| 4,073,442 | 2/1978 | Virving | 241/37 |
| 4,402,463 | 9/1983 | Kahmann et al. | 241/37 |

*Primary Examiner*—Joseph M. Gorski

*Attorney, Agent, or Firm*—Eric Y. Munson; Mark P. Stone

[57] ABSTRACT

The present invention provides a regulator for a refiner or grinding apparatus having opposed relatively rotatable grinding discs. Each grinding disc carries a grinding segment, and a predetermined gap or grinding space is defined between the grinding segments. The regulator, which is provided to compensate for axial variations in the predetermined grinding space due to variations of the load, includes a piston axially movable in a cylinder and a calibrated resilient element acting on the piston. The regulator is coupled to a hydraulic servo motor for the grinding discs, and the dimensions of the piston and cylinder of the regulator are selected to correspond to that of the servo motor, but in reduced scale. By calibrating the resilient element of the regulator to correspond to the axial load applied to the grinding discs, the displacement of the regulator piston corresponds to the relative displacement of the grinding disc and thus to a variation in the grinding space between the grinding discs. Variations in the grinding space are instantaneously and continuously counteracted by the regulator to maintain the grinding space at its predetermined value.

19 Claims, 4 Drawing Sheets

STRESS REGULATOR FOR PULP GRINDING APPARATUS AND METHOD

This application is a continuation of application Ser. No. 07/425,347, filed Sept. 27, 1989 now abandoned which is a continuation of Ser. No. 07/288,526, filed Aug. 4, 1988 now abandoned.

BACKGROUND OF THE INVENTION

The present invention relates to grinding apparatus with grinding discs which rotate relative to one another, defining therebetween a grinding space in which the material is ground under atmospheric or superatmospheric pressure and under corresponding temperature. The grinding discs are supported by an axially displaceable shaft or stator disc for adjustment of the spacing between the discs and which axial displacement is controlled by means of one or more servo motors. The grinding apparatus is principally intended for grinding lignocellulose-containing material in the form of chips or fiber products.

In order to achieve optimal grinding results, it is of great importance that the predetermined distance between the grinding discs is maintained constant during the grinding process, even in the event of variations in the amount of material to be ground. For example, the axial load on the grinding members can vary, for example, from zero tons at stoppage of the supply of material to 100 tons at full load of 25,000 kw.

During these axial load variations and with a fixed distance between the grinding elements in the range of 0.05 to 0.2 mm, depending upon the desired grinding result, it will be understood that extensions and retractions of the machine components which support the grinding elements may cause variations in the grinding space which exceed the pre-set value.

Variations in the grinding space defined between the two grinding elements under normal operation of a refiner are substantially linear with the axial load to which the grinding elements are subject.

This means that the space between the grinding elements can not be adjusted to the desired value during idling, but must be adjusted to the desired value during the actual grinding operation and at each change in the load factor.

In the event of sudden interruption in supply of material, the axial load is reduced to zero, with consequent neutralization of the extensions and retractions which are desired to be maintained in the apparatus, causing the spacing between the grinding elements to be immediately decreased to a degree where there will be frictional contact between the grinding discs.

Such frictional contact at a rotational speed on the order of 1,000 to 3,600 r.p.m. will cuase an immediate dry generated temperature increase up to the melting point of the grinding elements, with consequent destruction of the apparatus.

Several methods have been used heretofore in an attempt to prevent such destruction of the grinding elements. An example of these heretofore known methods is a load or feed sensor means which, for example, at decreased material supply or load, returns the grinding elements mechanically or hydraulically to a predetermined position free of contact between the grinding discs. Several such systems are described in Swedish Patent No. 214,707, corresponding to U.S. Pat. No. 3,212,721 and in Swedish Patent No. 395,372 and corresponding U.S. Pat. No. 4,073,442 which describe single disc refiners having sensor means including an electrically controlled extension metering system or an electrically controlled resistance measuring system, or a mechanically controlled sensor or a hydraulically actuated wedge shaped member by means of which the spacing between the grinding elements is controlled.

The sensor means of the aforementioned prior art, although useful, may exhibit certain disadvantages. The electrical metering systems may not react in sufficient time to prevent contact between grinding elements in the event of a sudden interruption of supply material which unexpectedly reduces the axial load to zero, particularly where the refiner is already operating at relatively small pre-set grinding space between the grinding elements. As discussed in U.S. Pat. No. 4,073,442, the electrical sensor means first separate the grinding elements only after initial metallic contact between the two occurs. Additionally, the use of an elecrical metering increases the overall cost of the refiner apparatus as a result of the necessary electrical components and labor required to install the same, and increases the possibility of malfunction of the apparatus as a result of failure of the electrical sensor system.

The use of mechanical control means, such as the wedge-shaped element 92 described in U.S. Pat. No. 3,212,721, provides mechanical control means to displace a piston a distance corresponding to the relative displacement of the grinding elements which displacement corresponds to variations or deviations of the grinding space from its preset value. However, movement of the wedge element 92 is subject to frictional and inertial constraints. Accordingly, in operation, the displacement of the piston controlled by the wedge may not be of a continuous and dynamic nature, may not precisely correspond to the actual variation from the preset grinding space between grinding elements of the refiner, and may not react quickly enough to cause the necessary corrective action to be taken to return the grinding space to its preset value.

SUMMARY OF THE INVENTION

According to the present invention, which is applicable to single disc refiners as well as double disc refiners, the regulator means which actuates the hydraulic adjusting means has been replaced by a hydraulically actuated axially displaceable piston having the same area relationship as on the hydraulic servo motor for the grinding elements. The piston works against a resilient element which is calibrated to operate with the same resilient constant as the sum of the extension and retraction of the axially loaded components of the grinding apparatus.

By hydraulically coupling this piston to the hydraulic servo motor for the grinding means, a variation in the length of this regulator system is achieved which corresponds fully to the extensions in the different apparatus components in the refiner. This regulator can be placed between the adjusting means for the refiner and its setscrew or between the adjusting means and its mounting in the apparatus frame, and will thereby always control the adjusting means by its variations in extension so that the servo motor piston will always be displaced in proportion to the changes in extensions arising in the apparatus and thereby will always maintain the set distance between the grinding elements, regardless of variations in axial load.

The regulator of the present invention may be employed in grinding apparatus having only one rotatable grinding element and one stationary grinding element, or in apparatus having two opposed rotatable grinding elements.

By application of the above described control technology to grinding apparatus having two relatively rotating grinding elements, both of which are controlled by a hydraulic servo motor, both rotating discs can be provided with separate control means according to above, or only one of the rotating discs and in which the resilient device included in the system is calibrated and constructed to correspond to the total extension in both sides of the apparatus. The same holds true if only one of the rotating discs is controlled by a hydraulic servo motor while the opposing disc is anchored mechanically. Other details and advantages of the invention will be described in conjunction with the following description of the drawings.

DESCRIPTION OF THE BEST MODE FOR CARRYING OUT THE INVENTION

Figure 1:
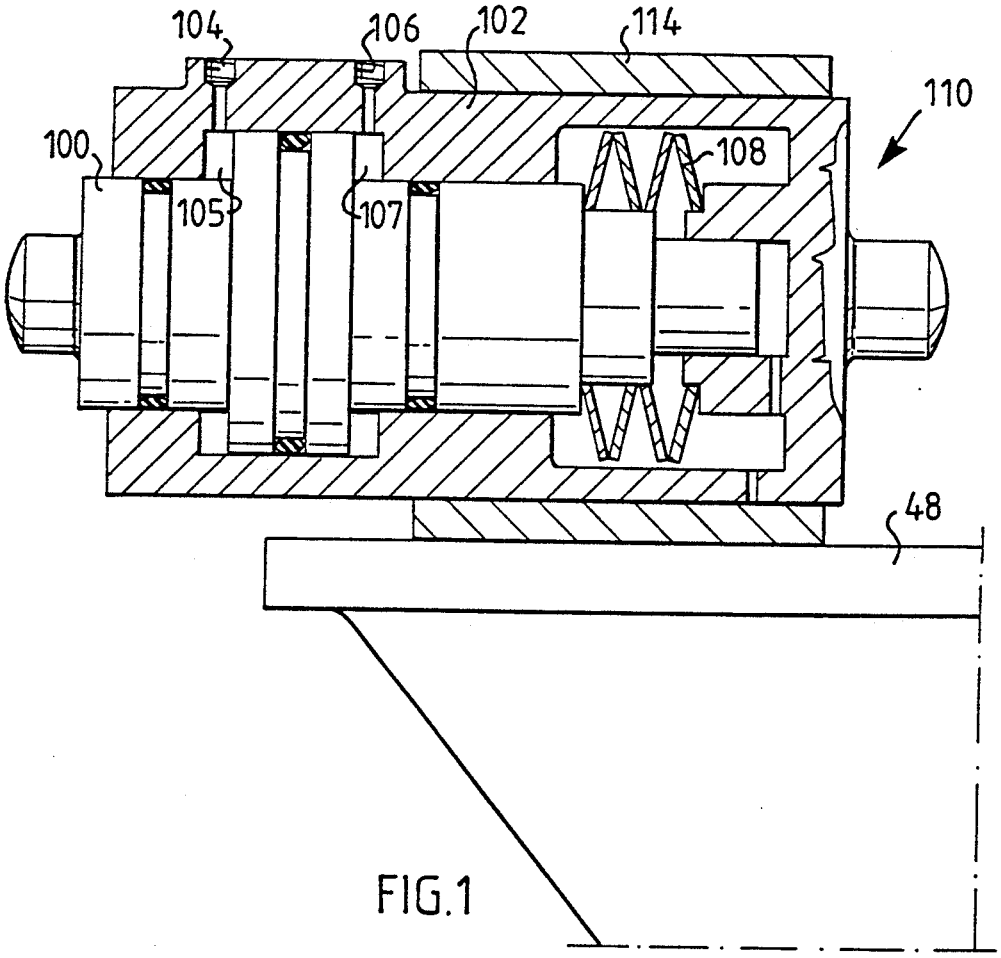
Fig. 1 shows an essential section of the control means.

Referring to FIG. 1 of the drawing, reference numeral 110 generally illustrates the control or regulator means of the present invention. The regulator 110 includes an hydraulic axially displaceable piston 100 enclosed in a cylindrical housing 102 forming two pressure chambers 105 and 107 with supply openings 104, 106 for the hydraulic pressure medium from a servo motor (described below) by means of which the piston 100 can be forced against a resilient element, as, for example, a spring device 108 enclosed in the cylindrical housing 102. The spring device is formed by calibrated spring plates having a resiliency constant proportional to the piston area of the control device 110 and respectively to the regulated combined extension and retraction of the axially loaded components of the grinding apparatus, as will be more fully described herein. The control means 110 is journalled in bearing 114,which is mounted by means of a console 48 to a housing for the servo motor of the grinding apparatus.

Figure 2:
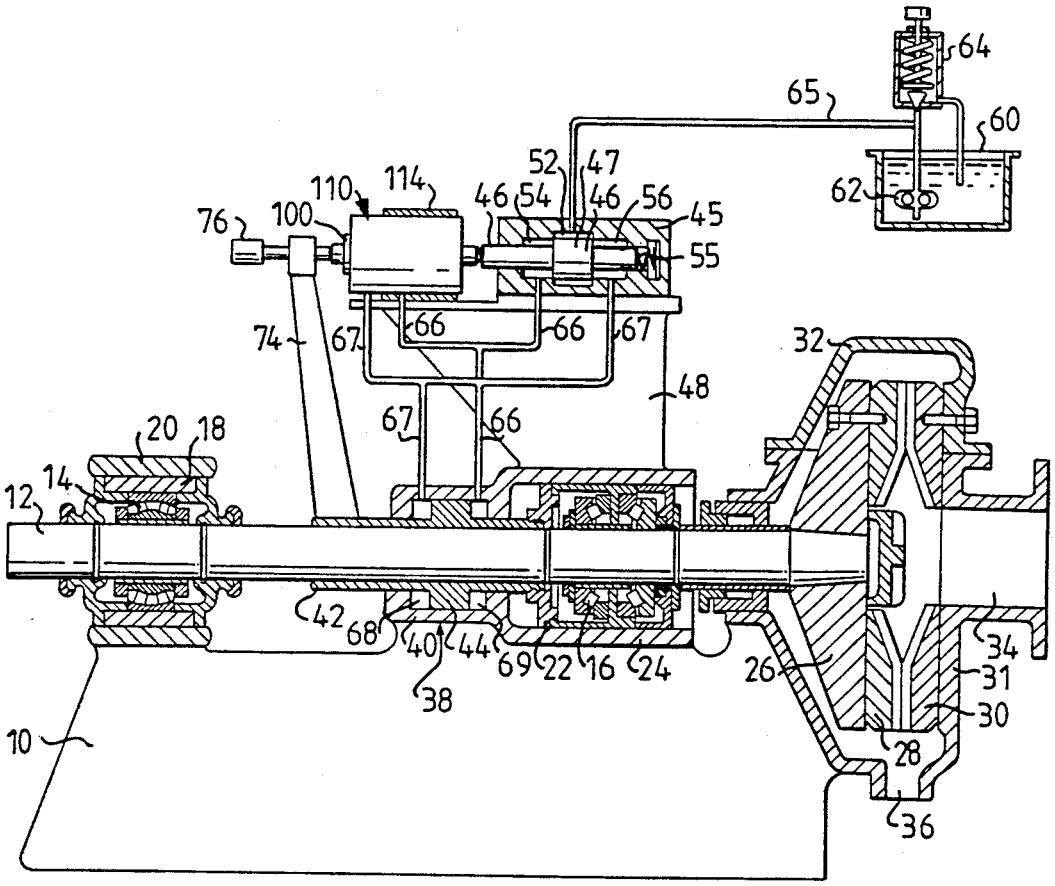
FIG. 2 shows the control means applied to a single disc refiner.

FIG. 2 shows a single disc refiner with the control device 110 placed between the control means for the refiner and its set-screw. The apparatus comprises a frame 10 in which shaft 12 is journalled into bearings 14, 16. The bearing 14 is housed within an inner bearing housing 18 and together with the latter is axially displaceable within an outer bearing housing 20.

In the same manner, the bearing 16, which is a combined axial and radial thrust bearing, is axially displaceable together with an inner bearing casing 22 within an outer bearing casing 24. The shaft 12 carries a rotor 26, onto which a grinding disc 28 is rigidly secured and thus is rotated together with the shaft. A stator 31 carrying a stationary grinding disc 30 is fastened by means of bolts to a casing 32, divided at a horizontal level above the shaft. The material to be ground is fed into the apparatus through a central channel 34 formed in the casing 32 and conveyed in an outward direction between the grinding discs 28 and 30, where it is disintegrated. Disposed in the base part of the casing 32 is a discharge opening 36 for removal of the ground fibrous material.

A hydraulic servomotor, generally designated by reference numeral 38, is provided around the shaft 12. The servomotor comprises a casing 40 which may be integrally formed with the bearing casing 24, and a piston 42, which is concentric with and, with play, surrounds the shaft 12 and bears against the inner casing 22. The piston 42 has a central flange 44, axially movable within the casing 40.

A positive pressure chamber 68 is defined on the left hand side of the servomotor flange 44, while a negative pressure chamber 69 is defined on the right hand side of the servomotor glange 44, as shown in FIG. 2. The expression "positive" means that in chamber 68 a hydraulic pressure is maintained which generates an axial pressure force component which is directed towards the stationary grinding disc 30. The expression "negative" means that in chamber 69 a hydraulic pressure is maintained which generates a force component acting in the direction opposite to that of the positive pressure.

The axial movement of a servomotor 38 is achieved and controlled by means of a pilot valve 45 and the extension regulator 110 or control means operatively coupled thereto. The pilot valve 45 is fixedly mounted to the servomotor housing 40, 24 by means of the console 48, while the extension regulator at control means 110 is journalled in a bearing 114 for axial displacement between the pilot valve 45 and a set screw 76. The set screw 76 is supported by a bracket 74 fixedly mounted to the servomotor piston 42 and is thus displaced along with the axial displacements of the servomotor piston 42 and shaft 12.

The servomotor 38, via the pilot valve 45 and the extension regulator 110 controls the predetermined spacing between the grinding discs 28, 30 and thus during the passage of the ground material through the grinding space between the discs counteracts the axial forces generated. The counteracting forces are generated by means of a hydraulic pressure medium which is supplied to a central chamber 52 from an oil sump 60 by means of pump 62 and conduit 65.

The pump 62 is controlled by a spring loaded valve 64. The central chamber 52 is located between a pressure chamber 56 (positive) and a pressure chamber 54 (negative). A conduit 67 connects the positive pressure chamber 56 and the positive pressure chamber 105 of the extension regulator or control means 110 to the positive pressure side 68 of the servomotor. A conduit 66 connects the negative pressure chamber 54 of the pilot valve 45 and the negative pressure chamber 107 of the extension regulator 110 to the negative pressure side 69 of the servomotor.

Operation of the apparatus illustrated by FIG. 2, including the control means illustrated by FIG. 1, which is employed in the refiner of FIG. 2, will now be described as follows. It is initially noted that the structure and operation of a basic disc refiner such as that illustrated by FIG. 2, but without the control means 110, is fully described in U.S. Pat. No. 3,212,721, issued Oct. 19, 1965, and U.S. Pat. No. 4,073,442, issued on Feb. 14, 1978. The disclosure in each of these two patents is expressly incorporated by reference herein for the purpose of further illustrating the structure and operation of basic refiners of the type with which the control means of the present invention is used.

Referring again to FIG. 2, oil of constant pressure is supplied from the pump 62 to the central chamber 52 of the pilot valve 45 through conduit 65. FIG. 2 shows the piston 46 in a neutral middle position in which the hydraulic pressure medium is distributed equally to the chambers 54 and 56 so that the same pressure will prevail in these two chambers as well as in the two chambers 69 and 68 in the servomotor 38. If the piston 46 should now move to the left in FIG. 2, the pressure in the space 56 will increase, while the pressure in the space 54 will decrease. This is due to the fact that the middle flange 47 opens up a greater connecting area between the central chamber 52 and the space 56, while at the same time, the area between the chamber 54 and the central chamber 52 is reduced. Consequently, a higher pressure will act on the piston flange 44 of the servomotor in the positive chamber 68 than in the chamber 69. If the piston 46 moves in the opposite direction, the result will be the reverse, i.e., the pressure in the servomotor chamber 69 will increase, and the pressure in chamber 68 will decrease. The material fed between the grinding discs 28 and 30 is thus subjected to a pressure, the magnitude of which depends upon the position of the piston 46 of the pilot valve and which is adjusted by the set screw 76 via the extension regulator 110.

The piston 46 is pressed constantly against the extension regulator 110 and the set screw 76 by a spring 55 of the pilot valve 45. Thus, the piston 46 follows the set screw as it moves in an axial direction. If the pressure between the grinding discs 28 and 30 increases, due to the accumulation of grist in the grinding space between the grinding discs, with consequent displacement of the rotating grinding disc 28 and servomotor piston 42 towards the left, the set screw 76 will move a corresponding distance in the same directions, since it is fixed to the bracket 74. The piston 46 will be similarly displaced under the resilient pressure exerted by the spring 55. During this displacement of the piston 46, the hydraulic pressure will increase in the pressure chamber 56, and, consequently, in the chamber 68 in the servomotor. Conversely, the hydraulic pressure in the pressure chamber 69 in the servomotor will decrease a corresponding degree, The increased pressure generates a counteracting force on the servomotor piston 42, in order to return the rotating grinding disc to its original position, and thus to restore the grinding space to its predetermined width. The grinding space should have a width preferably in the range of 0.01 mm, and 0.2 mm, depending upon the type of material to be refined.

On the other hand, in the event of interruption of feed of grist, the grinding discs will move towards one another as a result of the decreased load. The servomotor piston 42 and the set screw 76 will follow, causing the piston 46 of the pilot valve 45 to move toward the right. This movement of the piston 46 will in turn cause an increase in pressure in the pressure chamber 54 as well as in the servomotor chamber 69, and, conversely, a decrease in pressure in the chamber 56 and the servomotor chamber 68. By adjusting the set screw 76, the desired space between the grinding discs 28,29 can be increased or decreased. Therefore, the servomotor piston and the pilot valve are alternately actuated in response to momentary variations in the grinding space. As illustrated in FIG. 2, the piston 100 of the regulator 110 is in axial alignement with the piston 46 of the pilot valve 45. As also shown in FIG. 2, the forward end of the regulator piston 100 abuts directly against the opposed forward end of the pilot valve piston 46. As a result of this relationship, the pistons 46 and 100 are conjointly linearly movable or displaceable in the same direction along a common plane.

The extension regulator 110 shown in FIG. 1 is axially displaceable and located between the set screw 76 and the piston 46, as shown in FIG. 2. The regulator 110 is designed to compensate by changes in its longitudinal extension for stresses which are generated in the machine components which transmit the axial loads (grinding pressures) from the grinding members 28, 30 to the servomotor piston 44. The piston area of the stress regulator 110 has the same relationship as that of the servomotor, but in reduced scale. For example, if a hydraulic force of 10 tons is exerted on the piston of the servomotor in a certain direction, the regulator 110 may be designed so that 1/10th of the force (i.e., 1 ton of hydraulic pressure) is applied in the same direction as the regulator piston. The spring device 108 which forms part of the stress regulator 110, and against which the piston 100 abuts, is calibrated according to the regulator's piston area and to the elasticity or displacement of the apparatus during axial loads to produce an axial change in length of the stress regulator so as to counteract entirely the elastic stress changes at each load or stress level in the apparatus. That is, as a result of the relationship of the calibrated resilient element 108 to the pressure/surface area of the regulator 110 (which corresponds in scale to the displacement of the servomotor piston), the displacement of the regulator piston corresponds precisely to the displacement of the shaft 12 and the resulting deviation of the grinding space width from the preset value.

The position of the servomotor piston is adjusted by variation in the spacing between the end surface of the set screw 76 and the piston 46 of the pilot valve. If this spacing should be changed by changing the position of the set screw or by hydraulic adjustment of the total length of the stress regulator, the servomotor piston 44 and the shaft 12 are displaced to a corresponding degree.

By intercoupling the chamber 105 of the stress regulator 110 with the positive pressure chamber 56 of the pilot valve and the positive pressure chamber 68 of the servomotor and the chamber 106 of the stress regulator with the negative pressure chamber 54 of the pilot valve and the negative pressure chamber of the servomotor, the piston 100 of the stress regulator 110 is thus loaded, with the resultant load being the net pressure of the two pressure chambers 105 and 107.

This resultant force is entirely proportional to the axial pressure components applied to the servomotor piston 44, i.e., of the grinding members 28 and 30 and the axial force components generated by the superatmospheric pressure in the refiner housing 32, and thus causes an extension or retraction at each load moment of the spacing between the set screw 76 and the piston 46 of the pilot valve, which in turn causes the pilot valve to automatically adjust the servomotor piston so that variations in the spacing between the grinding members 28, 30 will be constantly counteracted and entirely eliminated, i, e., the predetermined grinding space will be maintained constant regardless of load variation.

It is therefore apparant that the regulator control means 110 of the present invention assures continuous and precise control and compensation for variations and deviations of the grinding space between the refiner discs from its preset value. This is accomplished by design of the pressure/surface area ratio of the regulator to correspond (in scale) to the pressure exerted on the grinding discs, and by calibrating the resilient element so that displacement of the regulator piston corresponds to displacement of the shaft carrying the rotatable grinding disc. The use of a resilient element, such as the calibrated regulator spring 108, eliminates the problems of frictional resistance encountered by the aforementioned mechanical wedge regulator elements to provide more precise and continuous monitoring and control of shaft displacement, and decrease the reaction time of the regulator to compensate for shaft displacement resulting from variations of the load. Preferably, the regulator has polished surfaces to further reduce any frictional resistance to the movement of the regulator spring 108 and the regulator piston 100. Although the preferred embodiment of the invention employs a calibrated spring 108 as the resilient element of the regulator 110, other calibrated resilient elements may also be employed.

By hydraulically coupling the regulator 110 to the pilot valve 45, the pilot valve operates, by hydraulic forces as described above, to stop displacement of the disc shaft within about a 0.01 mm movement. Displacement of the shaft simultaneously actuates the regulator element, which is hydraulically coupled to the pilot valve, to return the displaced shaft to its original preset position. The cooperation between the regulator and pilot valve results in an automatic, immediate and precise response to deviations in the preset grinding space and provides the immediate corrective action necessary to restore the grinding space to its preset value. Immediate, precise and automatic response is critical to preventing destruction of the grinding elements when a sudden and unexpected interruption in feed of material occurs, as previously discussed.

Figure 4:
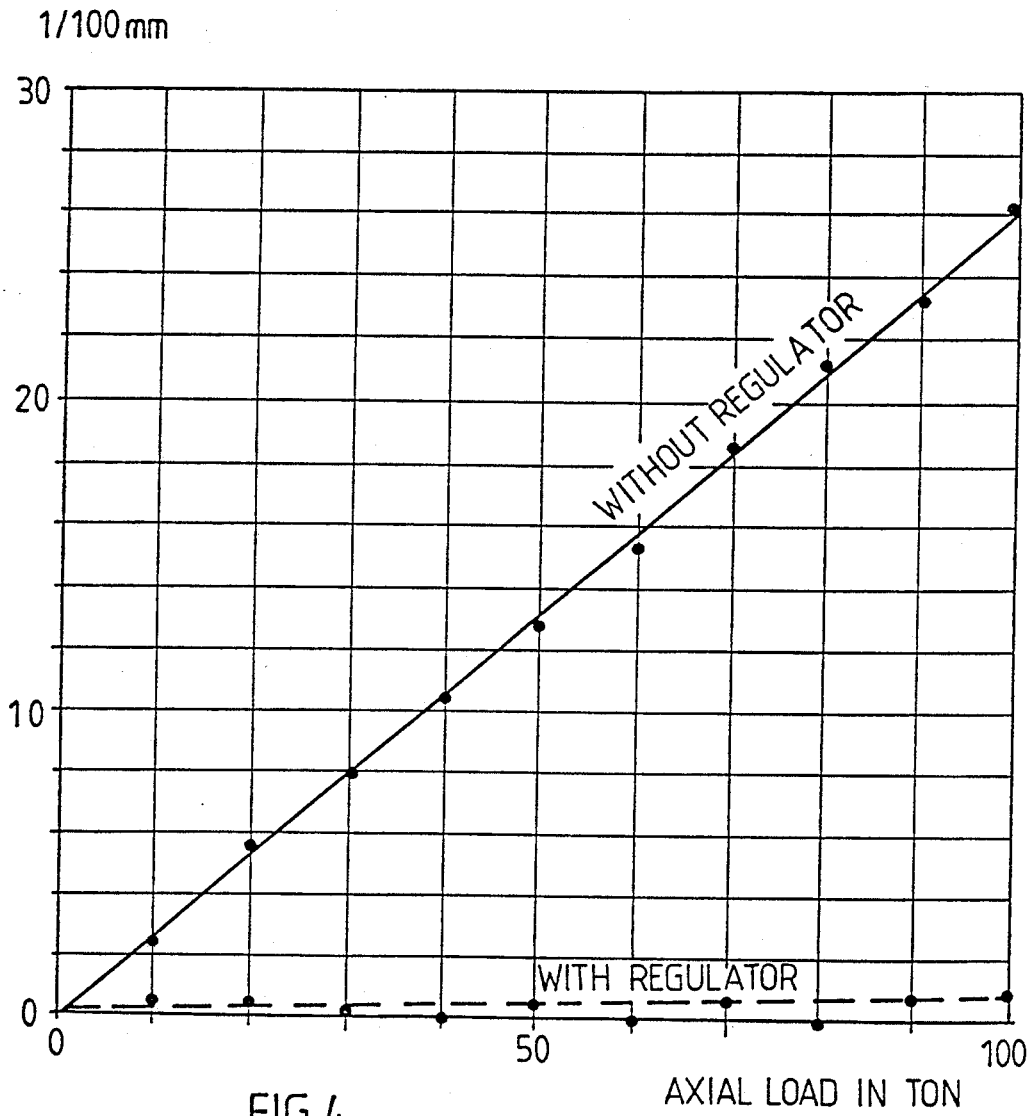
FIG. 4 shows a graph illustrating the manner in which the resilient element of one control means of the present invention is calibrated to result in precise and continuous control of the grinding space of a refiner.

FIG. 4 of the drawings is a chart illustrating how the resilient element or spring 108 of the regulator 110 is calibrated. The chart compares the axial load applied to the rotatable disc of a refiner, such as that illustrated by FIG. 2, to the displacement of the disc resultant from the applied axial load, without the regulator of the present invention. The chart also compares displacement of the resilient element to corresponding axial load on the disc to determine the corresponding values of spring displacement to shaft displacement. Using the test data, the proper calibrated values of the spring 108 may be determined so that spring displacement corresponds to disc displacement. As an example, the graph of FIG. 4 illustrates that a spring which is displaced about 0.03 mm at an applied axial load of 100 tons on the disc of the refiner corresponds to a disc displacement of about 0.26 mm. As apparent from the graph, both spring and disc displacement vary linearly with applied load.

Figure 3:
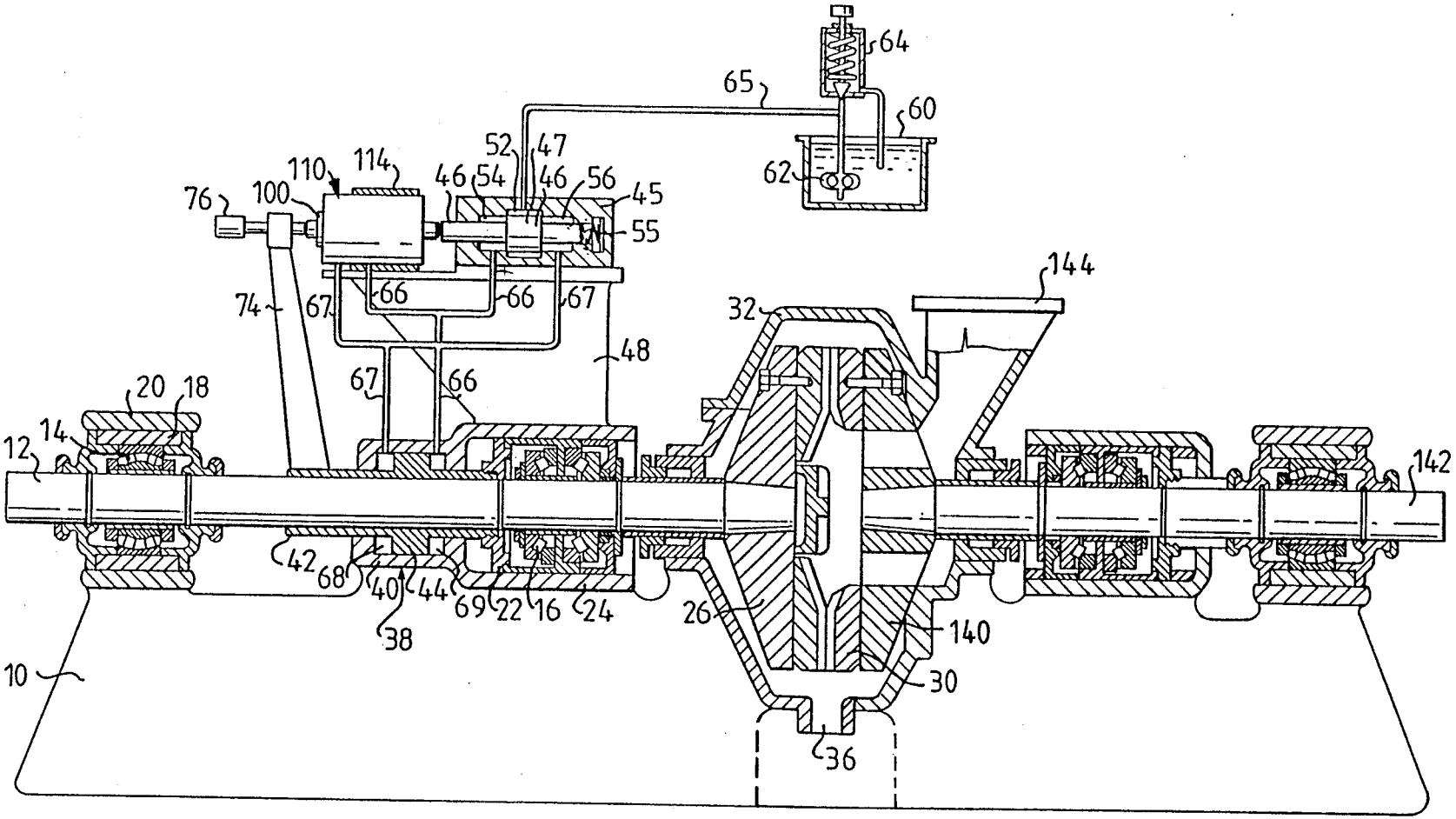
FIG. 3 shows the control means applied to a double disc refiner.

FIG. 3 of the drawings illustrates a double rotatable disc refiner employing the regulator means of the present invention. The basic structure and operation of the refiner illustrated by FIG. 3 is substantially similar to that of the refiner illustrated by FIG. 2, and corresponding reference numerals have been used in FIG. 3 where applicable. The basic difference between the refiners illustrated by FIGS. 2 and 3 is that the FIG. 3 refiner is a double disc refiner in which the grinding segment 30 is mounted to a rotor 140, and not a stator. The rotor 140 is mounted to and rotatable with a shaft 142. A servo motor 38 is operatively associated with each of the shaft 12 for monitoring and controlling the displacement of the shaft. Material to be refined is introduced into the grinding space between the two counter rotating grinding elements through a chute 144. In a double rotating refiner apparatus, the opposed grinding surfaces rotate in opposite directions, and the shafts carrying each of the rotatable grinding surfaces are individually axially displaceable as a result to the load between the grinding segments. An example of the basic operation of a double rotating disc refiner is described in my U.S. Pat. No. 4,378,092, the disclosure of which is incorporated by reference herein.

Still referring to FIG. 3, a sump, a pump, a pilot valve, a regulator device in accordance with the present invention and a set screw, are coupled only to the servo mechanism 38 which controls the displacement of the shaft 12. The operation of the regulator 110 is identical to that described with respect to FIG. 2, except that the resilient element or spring 108 of the regulator for the refiner of FIG. 3 is calibrated to compensate for twice the displacement of the shaft 12 and the grinding element carried by that shaft. As a result of the load in the grinding space between the two grinding elements, displacement of the shaft 12 represents only one-half of the deviation to the grinding space because a corresponding displacement of shaft 142 will also occur as a result of load variations. Accordingly, by calibrating the resilient element 108 of the single regulator element 110 to compensate for the displacement of both shafts 12 and 142, a single regulator element 110 may be used in the double rotating disc refiner.

It is, of course, possible to provide each of the rotatable discs and their supporting shafts with regulator elements, pilot valves, and set screws. This embodiment of the invention is not preferred, because it requires the provision of duplicate elements (i.e., sump, pump, pilot valve, regulator element, and set screw) and will therefore increase the cost of the overall refiner. However, an embodiment of the invention including separate regulator systems for each shaft would be preferable under circumstances in which a refiner is designed in a manner in which the opposed rotatable shafts would not be displaced the same distance as a result of variations of the load between the grinding segments.

Other advantages of the invention described herein will become apparent to those skilled in the art. Accordingly, the description of the preferred embodiment of the invention is intended to be illustrative only, and not restrictive of the scope of the invention, that scope being defined by the following claims and all equivalents thereto.

I claim:

1. In a grinding apparatus having a pair of opposed relatively rotatable grinding surfaces defining a grinding space therebetween, a servo mechanism for adjusting said grinding space, and first means coupled to said servo mechanism for actuating said servo mechanism, said first means including a pilot element fixedly mounted relative to said servo mechanism and a set screw for adjusting a preset distance between said grinding surfaces, said set screw being movable with said servo mechanism, and said first means having a central axis, the improvement comprising:

second means for actuating said servo mechanism comprising a regulator including a resilient element and a regulator piston driven by said resilient element, said regulator piston having a central axis, and said regulator being disposed between said pilot element and said set screw of said first means, said regulator piston being coupled to said first means and oriented therewith such that said central axis of said first means is aligned with said central axis of said regulator piston, for conjoint movement of said regulator piston and said first means in the same direction, said movement of said regulator piston corresponding to displacement of at least one of said grinding surfaces, said regulator adapted to maintain said grinding space between said grinding surfaces at said preset distance.

2. The improvement of claim 1, wherein said resilient element is calibrated such that it drives said regulator piston a distance corresponding to axial displacement of at least one of said grinding surfaces.

3. The improvement of claim 2, wherein said calibrated resilient element is a spring.

4. The improvement of claim 3, wherein said spring is formed from a plurality of spring plates.

5. The improvement of claim 1, wherein said regulator includes a cylinder in which said regulator piston is axially movable.

6. The improvement of claim 5, wherein said regulator is hydaulically coupled to said first means for actuating said servo mechanism.

7. The improvement of claim 6, wherein said regulator piston is dimensioned so that the hydraulic force applied thereto corresponds in scale to hydraulic forces applied to at least one of said grinding surfaces.

8. The improvement of claim 1, wherein said regulator maintains a preset distance between said two grinding surfaces, said grinding apparatus being a single rotatable disc refiner.

9. The improvement of claim 1, wherein said regulator maintains a preset distance between said two grinding surfaces, said grinding apparatus being a double rotatable disc refiner.

10. The improvement of claim 9, wherein said grinding apparatus includes two of said regulators, the first of said regulators being operatively associated with one of said rotatable grinding surfaces and the second of said regulators being operatively associated with the other of said rotatable grinding surfaces.

11. The improvement of claim 1, wherein said pilot element is a pilot valve.

12. In a grinding apparatus, a regulator for maintaining a preset grinding space between opposed grinding surfaces, the grinding apparatus, the grinding apparatus including a servo mechanism for adjusting said grinding space and first means for actuating said servo mechanism, said first means including a pilot element fixedly mounted relative to said servo mechanism and a set screw for adjusting a preset distance between said grinding surfaces, said set screw being movable with said servo mechanism, said regulator comprising a resilient element and a regulator piston driven by said resilient element, said regulator being disposed between said pilot element and said set screw, said regulator piston being coupled to said first means such that said first means in its entirety moves conjointly with said regulator piston in the same direction, said movement of said regulator piston corresponding to displacement of at least one of said grinding surfaces.

13. The regulator of claim 12, wherein said resilient element is calibrated such that it drives said piston a distance corresponding to axial displacement of at least one of said grinding surfaces.

14. The regulator of claim 13, wherein said resilient element is a spring.

15. The regulator of claim 14, wherein said spring is formed from a plurality of spring plates.

16. The regulator of claim 12, wherein said regulator piston is dimensioned such that hydraulic forces applied thereto correspond in scale to hydraulic forces applied to at least one of said grinding surfaces.

17. In a grinding apparatus having a pair of opposed relatively rotatable grinding surfaces defining a grinding space therebetween, a servo mechanism for adjusting said grinding space, and first means coupled to said servo mechanism for actuating said servo mechanism, said first means for actuating including a pilot element fixedly mounted relative to said servo mechanism and a set screw for adjusting a preset distance between said grinding surfaces, said set screw being movable with said servo mechanism, and said first means having a central axis, the improvement comprising:

a regulator including a resilient element and a regulator piston driven by said resilient element, said regulator piston having a central axis, and said regulator being disposed between said pilot element and said set screw of said first means for actuating, said resilient element being oriented in an axial direction relative to said regulator piston, said resilient element being adapted to displace said regulator piston a distance corresponding to axial displacement of at least one of said grinding surface, said regulator piston being oriented with said first means such that said central axis of said first means is aligned with said central axis of said regulator piston, such that the displacement of said regulator piston is monitored by said first means, said regulator being adapted to maintain said grinding space between said grinding surfaces at said preset distance.

18. The improvement of claim 17 wherein said regulator includes an actuating piston, said actuating piston being oriented in axial alignment with and in engagement with said regulator piston such that said actuating piston is displaced the same linear distance as said regulator piston.

19. The improvement of claim 17 wherein said resilient element is calibrated such that axial displacement of said regulator piston corresponds to axial displacement of at least one of said grinding surfaces, and said regulator piston is dimensioned so that the hydraulic force applied thereto corresponds in scale to hydraulic forces applied to said at least one of said grinding surfaces.

* * * * *